US005595526A

United States Patent [19]

Yau et al.

[11] Patent Number: 5,595,526

[45] Date of Patent: Jan. 21, 1997

[54] METHOD AND APPARATUS FOR ENDPOINT DETECTION IN A CHEMICAL/MECHANICAL PROCESS FOR POLISHING A SUBSTRATE

[75] Inventors: Leopoldo D. Yau, Portland; Paul B. Fischer, Hillsboro, both of Oreg.

[73] Assignee: Intel Corporation, Santa Clara, Calif.

[21] Appl. No.: 347,813

[22] Filed: Nov. 30, 1994

[51] Int. Cl.[6] ..... B24B 49/00; B24B 19/22

[52] U.S. Cl. ..... 451/8; 451/5; 451/41

[58] Field of Search ..... 451/8, 10, 11, 451/41, 9, 5, 21, 287, 290

[56] References Cited

U.S. PATENT DOCUMENTS 4,351,029 9/1982 Maxey et al. ..... 364/474
5,036,015 7/1991 Sandhu et al. .
5,069,002 12/1991 Sandhu et al. ..... 451/1
5,071,421 1/1992 Miller et al. .
5,216,843 6/1993 Breivogel et al. .
5,245,794 9/1993 Salugsugan ..... 451/10
5,308,438 5/1994 Cote et al. ..... 156/636
5,337,015 8/1994 Lustig et al. .

*Primary Examiner*—Robert A. Rose
*Attorney, Agent, or Firm*—Blakely, Sokoloff, Taylor & Zafman

[57] ABSTRACT

A method for polishing the surface of a substrate that overcomes the problems inherent in the prior art. During the polishing of a substrate, a quantity is calculated which is approximately proportional to a share of the total energy the polisher is consuming. Once this calculated quantity reaches a predetermined amount, it is detected.

14 Claims, 4 Drawing Sheets

METHOD AND APPARATUS FOR ENDPOINT DETECTION IN A CHEMICAL/MECHANICAL PROCESS FOR POLISHING A SUBSTRATE

FIELD OF THE INVENTION

The present invention relates to semiconductor processing and more particularly to a method of detecting an endpoint while polishing the surface of a semiconductor substrate.

BACKGROUND OF INVENTION

Integrated circuit (IC) devices manufactured today generally rely upon an elaborate system of conductive interconnects for wiring together transistors, resistors, and other IC components which are formed on a semiconductor substrate. The technology for forming these interconnects is highly sophisticated and well understood by practitioners skilled in the art. In a typical IC device manufacturing process, many layers of interconnects are formed over a semiconductor substrate, each layer being electrically insulated from adjacent layers by an interposing dielectric layer. It is extremely important that the surface of these interposing dielectric layers be as flat, or planar, as possible to avoid problems associated with optical imaging and step coverage which could frustrate the proper formation and performance of the interconnects.

As a result, many planarization technologies have evolved to support the IC device manufacturing industry. One such technology is called chemical mechanical polishing or planarization (CMP). CMP includes the use of lapping machines and other chemical mechanical planarization processes to smooth the surface of a layer, such as a dielectric layer, to form a planar surface. This is achieved by rubbing the surface with an abrasive material, such as a polishing pad, to physically etch away rough features of the surface, much in the same way sandpaper smoothes the surface of wood. Rubbing of the surface may be performed in the presence of certain chemicals which may be capable of chemically etching the surface as well. After a dielectric layer has been sufficiently smoothed using CMP, interconnects may be accurately and reliably formed on the resulting planar surface.

FIG. 1*a* illustrates a semiconductor substrate 10 upon which a layer of interconnects 11 has been formed. A dielectric layer 12 is deposited over the surface of interconnects 11. Note how the surface of dielectric layer 12 has conformed to the underlying topography of interconnects 11, resulting in the non-planar surface illustrated. FIG. 1*b* illustrates the substrate of FIG. 1*a* after CMP is used to polish back the surface of dielectric layer 12 to the surface of interconnects 11, planarizing the substrate. Another dielectric layer may be deposited on the flat surface of the substrate of FIG. 1*b* to form a flat dielectric surface upon which another interconnect layer may be formed.

A concern in CMP is how to etch a sufficient amount of material to provide a smooth surface without removing an excessive amount of the important, underlying materials. For example, if the CMP process used to form the substrate illustrated in FIG. 1*b* does not stop on the surface of interconnects 11, all or a portion of interconnects 11 may be etched away, destroying or at least hindering the operation of the resulting IC device. Therefore, a precise etch endpoint detection technique is needed for indicating when the CMP process has sufficiently planarized the surface of a substrate and should be stopped to prevent over-etching any underlying materials.

One method for endpoint detection is simply timing the CMP and halting the process when a predetermined period of time has elapsed. Unfortunately, the etch rates of similar substrates differ significantly depending on how worn-out the abrasive polishing pad becomes over time. Even if the polishing pad is continually reconditioned, consistent etch rates are difficult to maintain.

Another method for endpoint detection involves capacitive measurement of the dielectric film undergoing CMP, and using these measurements to determine the thickness of the dielectric film during etch. Once a predetermined thickness of the dielectric film is reached, the CMP process is halted. While this endpoint detection method overcomes the problems associated with shifting etch rates, the method is frustrated by the formation of multiple patterned layers on the semiconductor substrate. In addition, the method is only applicable to CMP of dielectric layers and is inadequate for damascene processes in which conductive layers are polished by CMP to form interconnects.

Another method for endpoint detection involves sensing the change in friction between CMP of the material being polished and the underlying material called a stopping layer. Once a change in friction is detected, indicating the stopping layer has been reached, the process is halted. This method is only effective if the coefficient of friction between the material being polished is different from the underlying material. Therefore, this method is wholly inadequate for planarizing dielectric layers to a consistent thickness in the process illustrated in FIGS. 2*a* and 2*b*.

FIG. 2*a* illustrates a semiconductor substrate 20 upon which a layer of interconnects 21 has been formed. A thick dielectric layer 22 is deposited over the substrate. FIG. 2*b* illustrates the substrate of FIG. 2*a* after the upper portion of dielectric layer 22 is planarized by CMP. Note that in this interlayer dielectric process, there is no underlying layer upon which a change in friction may be sensed. The CMP process is stoped midway through dielectric layer 22. Therefore, the method of endpointing a CMP process by detecting a change in friction between differing films would not work in this case.

A method for endpointing a CMP process is desired which accounts for shifting etch rates, can be performed on any material at any layer of the device, and doesn't rely on an underlying stopping layer.

SUMMARY OF THE INVENTION

A method is described for polishing the surface of a substrate that overcomes the problems inherent in the prior art. During the polishing of a substrate, a quantity is calculated which is approximately proportional to a share of the total energy the polisher is consuming. Once this calculated quantity reaches a predetermined amount, it is detected.

DETAILED DESCRIPTION

A method of polishing the surface of a substrate is described. In the following description, numerous specific details such as relative power and current levels, calculation methods, equipment designs, etc., are set forth in order to provide a more thorough understanding of the present invention. However, it will be apparent to one skilled in the art that the present invention may be practiced without employing these specific details. In other instances, well known processes, processing techniques, and mathematical derivations have not been described in detail in order to avoid obscuring the present invention.

While diagrams representing 'the present invention are illustrated in FIGS. 3–6, these illustrations are not intended to limit the invention. The specific methods described herein are only meant to help clarify an understanding of the present invention and to illustrate embodiments of how the present invention may be implemented in order to planarize a surface. For the purposes of this discussion, a semiconductor substrate is a substrate comprising any material or materials used in the manufacture of a semiconductor or opto-electric device. A substrate is a structure on which or to which a processing step acts upon.

Figure 3:
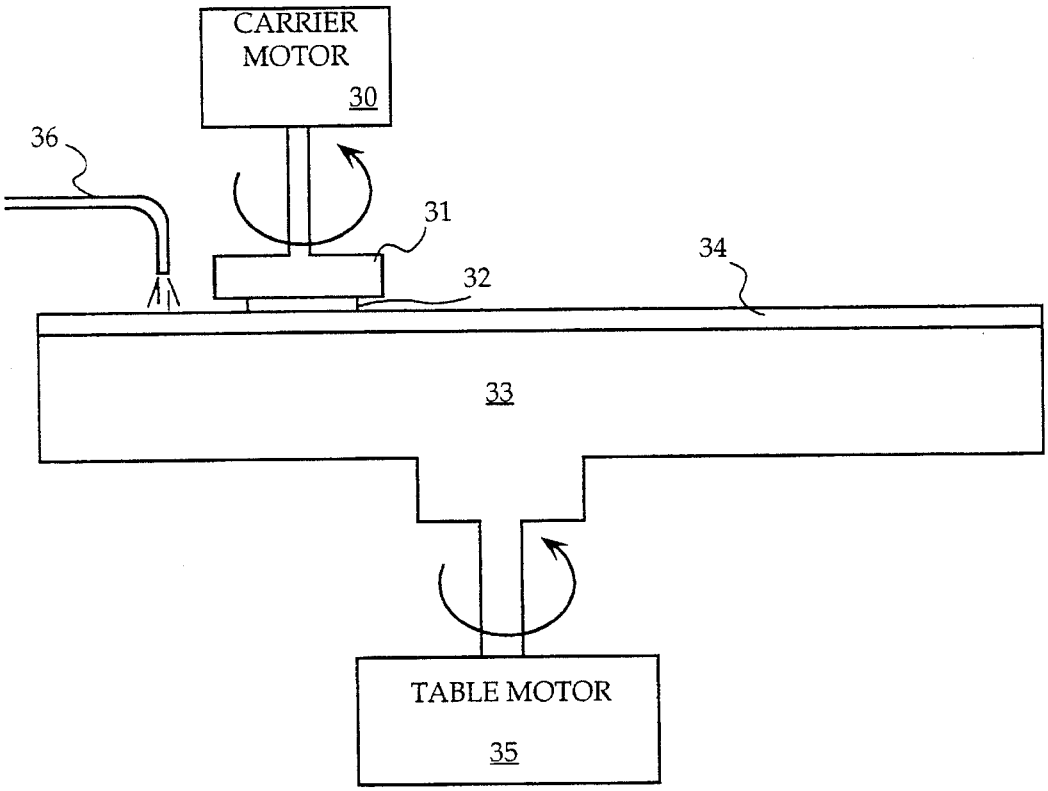
FIG. 3 is an illustration of a cross sectional view of a polisher.

FIG. 3 illustrates a chemical mechanical polisher used for chemical mechanical polishing or planarization (CMP) of semiconductor substrates. The polisher comprises a semiconductor substrate carrier 31 to which a semiconductor substrate 32 is affixed. Substrate carrier 31 is rotatably coupled to an electric drive motor called a carrier motor 30. A polishing surface 34 is attached to the top of table 33. Table 33 is rotatably coupled to another electric drive motor called a table motor 35. Finally, a spigot 36 is used to transport a polishing agent, called a slurry, to polishing surface 34. The slurry may comprise abrasive particulate matter to aid in mechanically etching the substrate, chemical agents to aid in chemically etching the substrate, or a mixture of both.

Figure 2A:
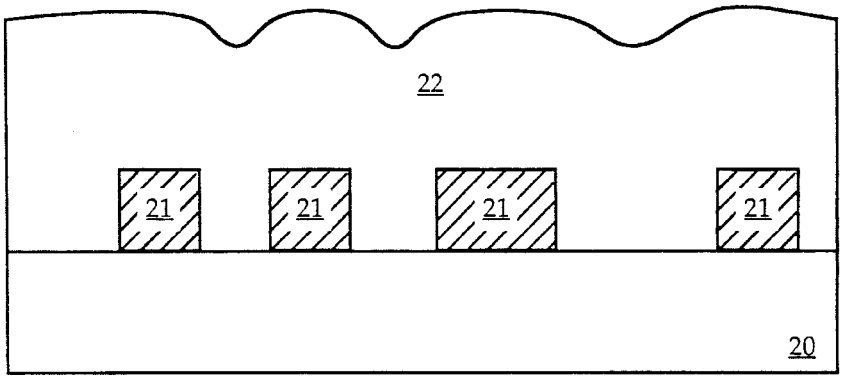
FIG. 2*a* is an illustration of a cross sectional view of a semiconductor substrate showing an interconnect and dielectric layer.
Figure 2B:
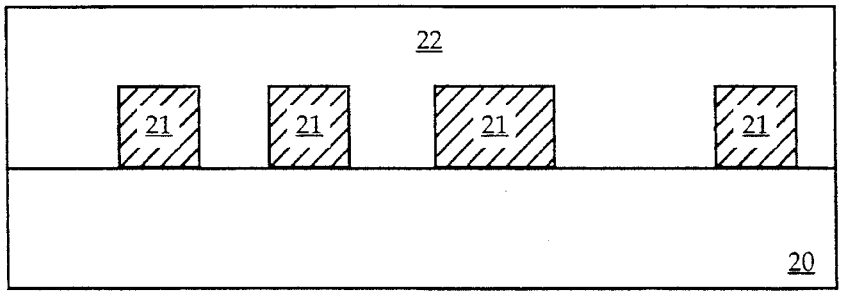
FIG. 2*b* is an illustration of a cross sectional view of the substrate of FIG. 2*a* after an upper portion of the dielectric layer has been polished.

Semiconductor substrate 32 is mounted to carrier 31 face down so that the top surface of substrate 32 is pressed against polishing surface 34 by carrier 31. Substrate 32 typically comprises a silicon wafer upon which integrated circuit (IC) components have been formed. The upper surface of substrate 32 is illustrated in FIG. 2*a* where the presently described polishing process is used to planarize an interlayer dielectric film comprising dielectric layer 22 over a layer of interconnects 21.

Alternatively, for some polishing applications, such as trench isolation etch-back, IC components have not yet been formed on the silicon wafer. In other embodiments, the film to be planarized comprises a conductive material such as, for example, Cu in advanced damascene techniques for forming Cu interconnects. In alternate embodiments of the present invention, the semiconductor substrate to be planarized comprises alternate semiconductor materials used to manufacture an IC device. In general, techniques in accordance with the present invention are applicable in virtually any manufacturing process in which a practitioner desires to planarize the surface of a substrate.

Polishing surface 34 is fixedly attached to the upper surface of table 33 and comprises a polishing pad capable of transporting materials in the slurry to semiconductor substrate 32. The polishing pad is slightly roughened to aid in the mechanical polishing of the semiconductor substrate. In addition to the features illustrated in FIG. 3, the polisher incorporates a computerized user interface for control and access of information related to the polishing process.

To begin the chemical mechanical polishing (CMP) process, carrier motor 30 rotates carrier 31, which in turn rotates semiconductor substrate 32 against polishing surface 34. Concurrently, table motor 35 rotates table 33, which in turn rotates polishing surface 34 against semiconductor substrate 32. While the motors rotate the carrier and table, spigot 36 distributes a slurry onto polishing surface 34, and semiconductor substrate 32 is polished. It has been found that by rotating both the carrier and the table in this manner, a more uniform, planar, polished surface is formed on the semiconductor substrate than can be formed by rotating either the carrier or table alone.

Alternatively, as polishing technology advances, polisher designs may change, but polishing techniques in accordance with the present invention will continue to be applicable to nearly any polisher design. For example, in an alternate polishing system, additional motors may be incorporated into the basic system illustrated in FIG. 3 to add additional axes of rotation between the semiconductor substrate and the polishing surface. For example, an off-axis secondary table motor and an off-axis secondary carrier motor may be coupled to the main table motor and main carrier motor, respectively, to provide two additional axes of rotation. Alternatively, the table motor may be removed so that the table remains stationary, while an additional motor is coupled to the carrier motor to rotate the carrier motor and carrier around the table.

A certain amount of energy is required to polish a film. As illustrated in FIGS. 1*a*–2*b*, polishing a film necessarily requires that some portion of the film's surface he etched away. More energy is required to etch away a thicker portion of a film than to etch away a thinner portion of the same film. Therefore, the total energy required to polish a film to a particular depth is proportional to the portion of film removed from the surface during the polishing process. This concept may be applied to polishing systems to determine the amount of film removed during the polishing process by calculating the total energy used by a polishing system to polish a particular film. Thus, a method for endpointing the polishing process is enabled.

To implement an endpoint detection method in accordance with the present invention, a practitioner initially determines the total amount of energy required to polish a film to a desired thickness. Determining the required total energy is accomplished by a trial and error technique wherein a film is first polished using a known amount of energy. The film is then checked for planarity and its thickness is measured by analyzing cross-sections of the film under a high-power microscope such as a scanning electron microscope (SEM). Various factors are considered in determining the proper level to which a polishing step should etch the surface of a substrate.

Figure 1A:
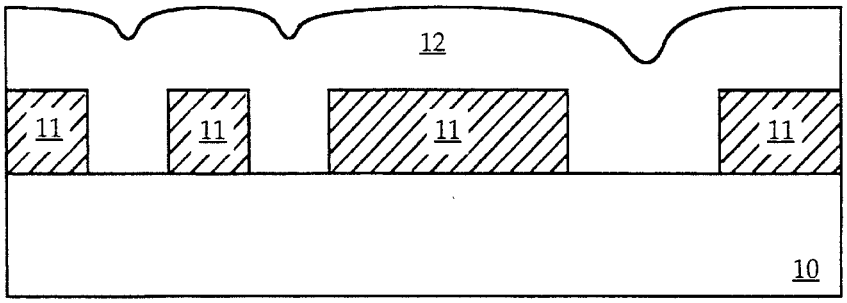
Figure 1a (Prior Art)
FIG. 1*a* is an illustration of a cross sectional view of a semiconductor substrate showing an interconnect and dielectric layer.
Figure 1B:
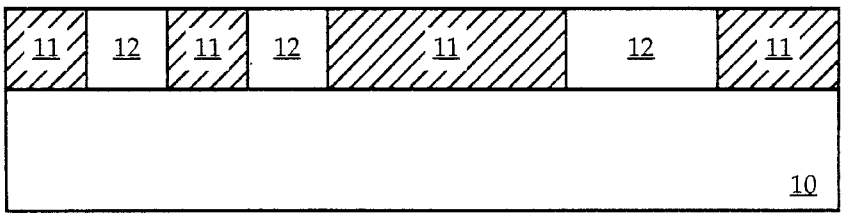
Figure 1b (Prior Art)
FIG. 1*b* is an illustration of a cross sectional view of the substrate of FIG. 1*a* after the dielectric layer has been polished.

For example, one factor to consider in the process illustrated in FIGS. 1*a* and *b* is that dielectric film 12 should be etched back to the surface of interconnect features 11 without overetching these interconnect features. In the process illustrated in FIGS. 2*a* and *b*, interlayer dielectric film 22 is etched to some intermediate position within the film, as illustrated. This intermediate position should be deep enough to planarize the surface, but not so deep that interconnect features 21 are exposed. In addition, interlayer dielectric film 22 should remain thick enough, after CMP, to provide sufficient electrical isolation between underlying interconnects 21 and interconnects subsequently formed on the film's surface. Cross-capacitance becomes a consideration in determining this thickness. Also, in a damascene interconnect formation process, the conductive film should be etched back to the surface of the dielectric features with enough overetch to achieve the desired interconnect thickness. Finally, in a trench isolation process, the trench fill material should be etched back to the surface of the semiconductor substrate mask without damaging the surface of the underlying semiconductor material.

When a cross-section containing the proper film thickness and topography is identified, the total energy used to polish that particular substrate becomes the total energy target for that process step. A total energy target is the amount of energy necessary to polish the surface of a substrate to a desired level. Once the total energy target is determined for a substrate, similar substrates are polished to approximately the same level when the polisher used to polish these substrates is provided with an amount of energy equal to the total energy target. Thus, an endpoint detection method is enabled. The total energy being consumed by a polisher during CMP of a substrate is continually calculated. Once the total energy consumed reaches the total energy target, the endpoint has been reached and CMP is stopped. Alternatively, an endpoint may be determined by a combination of calculating the total energy consumed along with a timed polish or other endpoint technique.

Many factors should be taken into account when calculating the total energy. For example, as described above, a chemical mechanical polisher may comprise several different motors used to polish the surface of a semiconductor substrate. In addition, a typical polisher comprises many other features such as a computer interface for controlling the polisher and downloading information, and a pump for transporting the slurry. Many of these features require a certain amount of energy to operate. Therefore, not all the energy consumed by the polisher goes toward polishing the substrate. Some energy is lost as the heat of friction within the motors, resistance in the electrical lines, operator interface for the polisher, operation of the slurry pump, etc.

Some of this lost energy, such as the loss due to electrical line resistance, is lost at an approximately equal rate for all substrates polished. Constant energy loss factors such as these can be accounted for in total energy calculations, thereby avoiding any significant impact on substrate to substrate variation in film thickness. On the other hand, energy losses due to, for example, a computer interface may vary depending on factors such as whether or not data is being downloaded from the interface while a particular substrate is being polished. For this reason, measurements for the total energy calculations described above are taken as close to the point of polish as possible so as to minimize extraneous factors and improve accuracy. Therefore, the total energy consumed by the chemical mechanical polisher is monitored at one or more of the polisher's motors in accordance with the present invention.

As stated above, the total amount of material etched from the surface of a substrate during CMP of the substrate is proportional to the total energy required to polish the substrate.

$$Th_r \alpha E_{tot} \qquad \text{Eq. (1)}$$

where $Th_r$=thickness removed $E_{tot}$=total energy consumed

In general, the total energy consumed by a motor is equal to the power drawn by the motor, integrated over time. For a simple direct current (dc) motor with constant drag and constant power drawn by the motor, the energy E is defined by $$E = \text{Power} \times \text{Time}$$

However, for most polishers, motors operate under alternating current (ac) conditions, in which case the total energy $E_{tot}$ consumed by a motor is defined by $$E_{tot} = \int_0^T P(t)dt \qquad \text{Eq. (2)}$$

where

Figure 4:
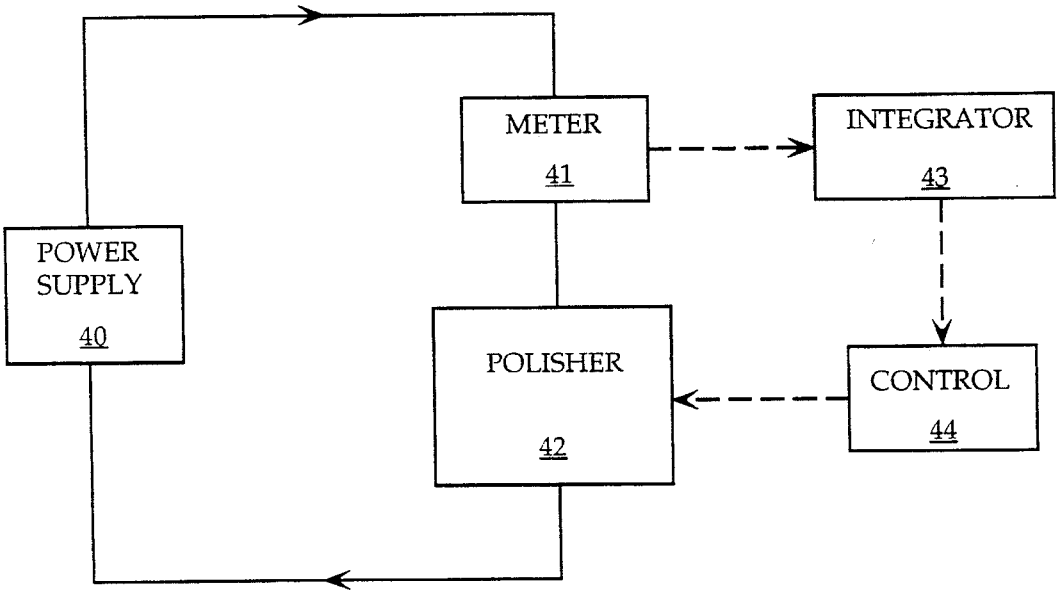
FIG. 4 is an illustration of an endpoint detection technique in accordance with the present invention.

P=instantaneous power t=time variable, integrated over the range from CMP start time 0 to CMP finish time T FIG. 4 is a block diagram illustration of how the present invention is implemented in a polishing system. A power supply 40 supplies power to polisher 42 while meter 41 measures the power being drawn by the carrier and table motors of the polisher. An integrator 43, coupled to meter 41, is used to integrate the power drawn by the motors over the course of the polishing time. Integrator 43 calculates the total energy ($E_{tot}$) consumed by the motors in accordance with Eq. (2) above. Control 44, coupled to integrator 43 and polisher 42, comprises circuitry which senses when $E_{tot}$ reaches the total energy target, then signals polisher 42 to stop polishing.

Alternatively, the meter measures the amount of power being drawn only by the carrier motor. In general, the meter, or a plurality of meters, may be placed at any point within the polisher to provide the most accurate and consistent indication of 'total energy used by the polisher to directly etch material from the surface of the substrate being polished. If a plurality of meters is employed, the integrator may first add the power measurements, then integrate the total, integrate the measurements from each meter, then add the energies, or a combination of both.

As stated above, not all the energy consumed by the polisher goes towards etching the surface of the substrate being polished. There is a certain amount of overhead energy consumed by the polisher which has not been accounted for in Eq (2). The meter is placed at a position within the polisher to minimize the effects of overhead energy on 'total energy calculations. Unfortunately, a practitioner may not be able to eliminate all contributions of overhead energy, such as the energy required to overcome friction within the motors, simply by proper placement of a meter. In addition, there may be some chemical etch component of CMP not requiring polish energy. Therefore, a more accurate equation to describe the total energy necessary to polish a substrate is $$E_{tot} = \int_0^T P(t)dt - f(t) \quad \text{Eq. (3)}$$

where f(t)=overhead energy and the effects of any chemical etch component not requiring polish energy The overhead energy factor f(t) of Eq. (3) may be determined empirically and is subsequently accounted for when calculating the total energy. In a case in which f(t) is a constant value (time independent) for every substrate being polished, f(t) may be ignored since it effects the total energy calculation of each substrate identically, thereby canceling itself out. This may be the case when a finite amount of overhead energy is required to initiate the CMP process for each substrate being polished. However, typically, f(t) is dependent on the total polish time, T, and should be accounted for. For simplicity, the embodiments described below assume the factor f(t) is negligible. It is to be appreciated by a practitioner skilled in the art that the contribution of overhead energy factor f(t) should be incorporated into these embodiments to improve accuracy.

Note that Eq. (2) may be rewritten as $$E_{tot} = \int_0^T I(t) \cdot V(t) \cdot \cos\theta dt \quad \text{Eq. (4)}$$

where

I(t)=current

V(t)=voltage

θ=phase angle between I(t) and V(t)

As shown in Eq. (1) above, the thickness etched from the surface of a substrate during CMP of the substrate is merely proportional to the total energy. Therefore, it is not necessary to accurately calculate $E_{tot}$ for endpoint detection purposes in alternate embodiments of the present invention. Instead, calculating a quantity which is merely proportional to $E_{tot}$ may suffice.

For example, in an embodiment in which the phase angle θ is the same for all substrates polished, and the voltage supply to the motors is relatively constant over a substantial period of time, Eqs. (1) and (4) simplify to $$Th_r \propto E_{tot} \propto \int_0^T I(t) \quad \text{Eq. (4)}$$

In such an embodiment, meter 41 of FIG. 4 may comprise an ammeter to measure the current drawn by the polisher's motors. Analogously, in an alternate embodiment in which the motors utilize a constant current source, meter 41 may comprise a voltmeter to measure the voltage drawn by the polisher's motors. In another embodiment, the meter may provide information on other parameters relating to power or frictional force such as instantaneous power, time averaged power, instantaneous current, instantaneous voltage, rms current, rms voltage, apparent power, inductance, torque, drag, etc.

In general, in accordance with the present invention, any parameter which is approximately proportional to power (which may include power itself) is integrated over a period of time during the polishing of a substrate. As a result, a quantity is continually calculated which is approximately proportional to the total energy (which may include the actual total energy) being consumed to polish the substrate. An endpoint is reached when the calculated quantity reaches the target quantity. For a particular process step in production, this target quantity is determined before-hand by the trial and error technique described above or may be calculated where the process parameters have been well-characterized.

Figure 5:
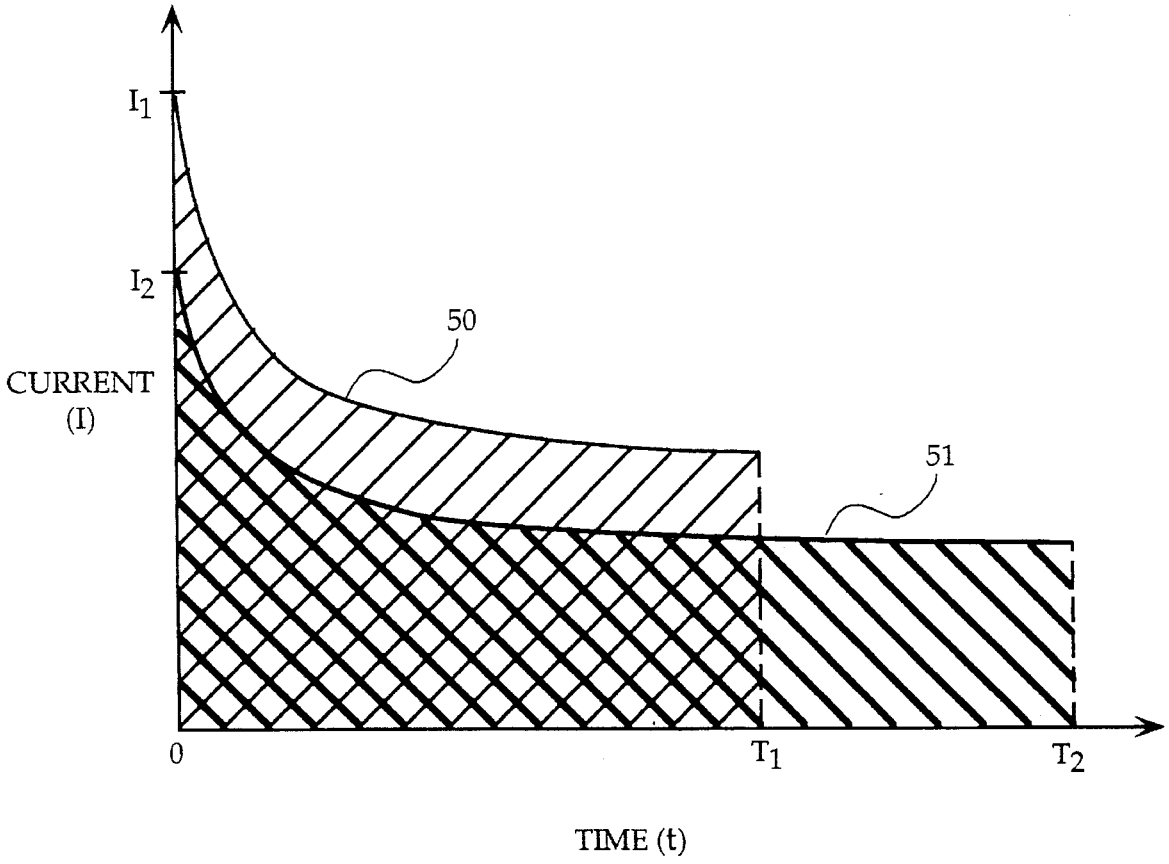
FIG. 5 is a graph illustrating current measurements versus time in a chemical mechanical polisher.

FIG. 5 is a graph illustrating the currents drawn by a carrier motor in a particular embodiment of the present invention in which the surface of an interlayer dielectric (ILD) film is polished back to a consistent thickness on each of two separate semiconductor substrates. The amplitude of the voltage supplied to the carrier motor is relatively constant. The current (rms) drawn by the carrier motor to polish the first ILD film over a first period of time is illustrated as curve 50.

As illustrated, at time t=0, CMP of the first ILD film begins with the carrier motor drawing an initial current $I_1$. As time passes, the surface of the first ILD film becomes smoother, so the frictional force between the first ILD film and the polishing pad decreases. Because the frictional force decreases, the carrier motor requires less power to rotate the semiconductor substrate against the polishing pad. Consequently, the current drawn by the carrier motor similarly decreases, as illustrated, until a relatively steady state is reached near time $t=T_1$.

As the first ILD film is polished, the current drawn by the carrier motor is integrated over time according to Eq. (4). By integrating the current, a quantity is continually calculated which is approximately proportional to the total energy consumed by the carrier motor over time. This quantity is, in turn, approximately proportional to the thickness of ILD material being removed from the surface of the semiconductor substrate by CMP. Integrating the current drawn by the carrier motor is equivalent to calculating the area under curve 50. Note that "continually" in this context is meant to indicate that enough current samples are taken to provide an accurate enough representation of the total area under curve 50 as would be required by the tolerances of a particular process step. Once the area under curve 50 reaches a predetermined amount, indicating the endpoint of the first ILD film has been reached, CMP is stopped. This occurs at time $t=T_1$.

Next, CMP of the second ILD film begins on the second semiconductor substrate, illustrated by curve 51, with the carrier motor drawing an initial current $I_2$. Note that $I_2$ is significantly less than $I_1$. This is because the polishing pad used to polish the ILD films has been worn down by the first ILD film, lessening the frictional force between the second ILD film and the pad. As time passes, the surface of the second ILD film becomes smoother through the polishing process, so the frictional force between the second ILD film and the polishing pad decreases, further lessening the current as illustrated.

As the second ILD film is polished, the current drawn by the carrier motor is integrated over time according to Eq. (4). By integrating this current, a quantity is continually calculated which is approximately proportional to the total energy consumed by the carrier motor over time. This quantity is, in turn, approximately proportional to the thickness of ILD material being removed from the surface of the semiconductor substrate. Since it is desired that the CMP process remove the same amount of material from both the first and second ILD films, CMP of the second ILD film is stopped when this calculated quantity reaches the same predetermined amount used to endpoint the CMP of the first ILD film. This occurs when $t=T_2$.

Building on Eq. (4) we have $$Th_{1r} \alpha E_{1tot} \alpha \int_0^{T_1} i_1(t)$$

for the first ILD film, and $$Th_{2r} \alpha E_{2tot} \alpha \int_0^{T_2} i_2(t)$$

for the second ILD film. Setting the removed thicknesses equal to each other results in $$E_{1tot} = E_{2tot} \quad \text{Eq. (5)}$$

or $$\int_0^{T_1} i_1(t) = \int_0^{T_2} i_2(t)$$

The consequence of Eq. (5) is that the area under curve 50 is equal to the area under curve 51. More importantly, assuming the initial thickness of the first ILD film is equal to the initial thickness of the second ILD film, the final, CMP polished thickness of the first ILD film is equal to the polished thickness of the second ILD film. As indicated in Eq. (3), the equality in Eq. (5) may be modified by the overhead energy factor f(t) which can be determined experimentally for a repetitive process in high volume production.

Note in the graph of FIG. 5 that a timed CMP process would not be adequate to polish both films to the same desired thickness. This is because it takes longer for subsequently polished substrates to be polished to the same level as initially polished substrates since the polishing pad becomes worn out over time. Also note that an endpoint detection technique in accordance with the present invention does not rely on a stopping layer. Instead, calculating a quantity which is proportional to the total energy consumed by a polishing motor during CMP provides a real-time indication of the amount of material removed from the surface of a substrate being polished.

Figure 6:
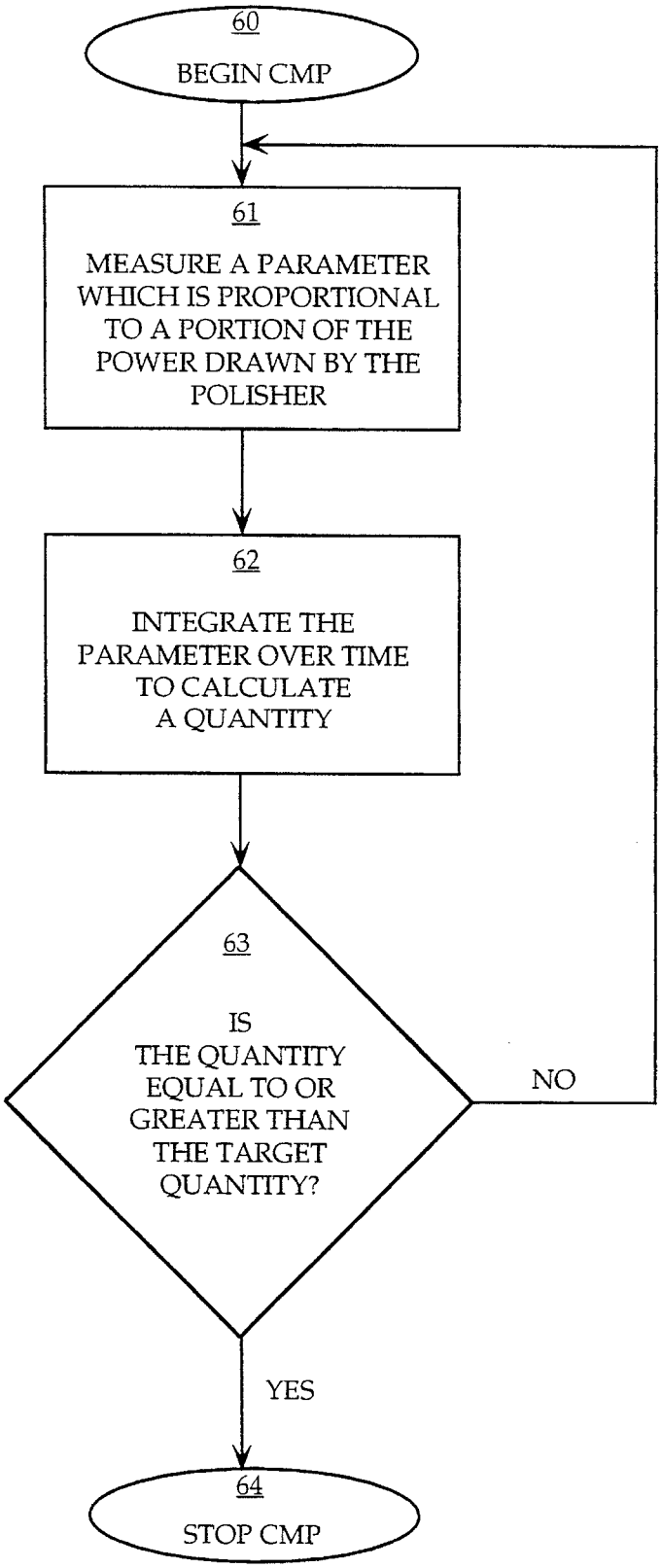
FIG. 6 is a flow chart illustrating five steps in accordance with the present invention

FIG. 6 is a flow chart illustrating five steps in accordance with the present invention. In step 60, CMP is initiated. In step 61, a parameter is measured which is proportional to some share of the total power drawn by the polisher. As described above, this share of power may be the power drawn by the carrier motor, the table motor, or any other motor or combination of motors. Some suitable parameters have been described above. In step 62, the parameter of step 61 is integrated over the CMP time to calculate a quantity. As described above, the quantity which is calculated may not only include a factor which is proportional to the total energy consumed but also an overhead energy and chemical etching factor.

In step 63, the calculated quantity of step 62 is compared to the target quantity which has been determined beforehand as described above. If the calculated quantity is less than the target quantity, the parameter continues to be measured and integrated as illustrated in steps 61 and 62. Once the calculated quantity is equal to or greater than the target quantity, CMP is complete and the process is stopped as illustrated in step 64.

Thus, a CMP process has been described which improves the uniformity in thickness among polished films of multiple substrates by accurate endpoint detection techniques.

What is claimed is:

1. In a chemical/mechanical process for polishing a substrate, a method of endpoint detection comprising the steps of:

(a) determining a target amount of energy needed by a polishing apparatus to produce a desired polishing result on the substrate;

(b) providing an energy source to the polishing apparatus to commence the chemical/mechanical process;

(c) calculating a total energy consumption by integrating over time an electrical parameter of the polishing apparatus that is approximately proportional to an instantaneous power consumed by the polishing apparatus; and (d) stopping the chemical/mechanical process when the total energy consumption equal the target amount of energy.

2. The method of claim 1 wherein the electrical parameter comprises a current supplied to a motor of the polishing apparatus.

3. The method of claim 1 wherein the electrical parameter comprises a voltage supplied to a motor of the polishing apparatus that utilizes a constant current source.

4. The method of claim 1 wherein step (c) comprises the steps of:

performing measurements of the electrical parameter in a time period;

integrating the measurements over the time period to produce a first energy quantity;

subtracting an overhead energy contribution from the first energy quantity, resulting in the total energy consumption.

5. The method of claim 4 wherein the overhead energy contribution includes a chemical etch component.

6. The method of claim 1 wherein the desired polishing result is a planarized surface of a dielectric film disposed over a layer of interconnects.

7. In a chemical/mechanical process for polishing a semiconductor substrate, a method of endpoint detection comprising the steps of:

(a) determining a target amount of energy needed by a polishing apparatus to produce a desired polishing result on the semiconductor substrate;

(b) energizing a plurality of motors in the polishing apparatus to begin the chemical/mechanical process;

(c) repeatedly performing parametric measurements to calculate a total energy consumed by the motors over a time period;

(d) stopping the chemical/mechanical process when the total energy consumed by the motors over the time period equals the target amount of energy.

8. The method of claim 7 wherein the plurality of motors includes a first motor that rotates a polishing surface, and a second motor that rotates the semiconductor substrate against the polishing surface.

9. The method of claim 8 wherein step (c) includes the step of:

measuring a first current supplied to the first motor.

10. The method of claim 9 wherein step (c) further includes the step of:

measuring a second current supplied to the second motor.

11. The method of claim 10 wherein step (c) further includes the step of:

integrating the first and second currents over the time period.

12. The method of claim 10 wherein step (c) further includes the step of:

subtracting an overhead energy contribution to the total energy consumed.

13. The method of claim 12 wherein the overhead energy contribution includes a chemical etch component.

14. The method of claim 7 wherein the desired polishing result is a planarized surface of a dielectric film disposed over a layer of interconnects.

* * * * *

UNITED STATES PATENT AND TRADEMARK OFFICE

CERTIFICATE OF CORRECTION

PATENT NO. : 5,595,526

DATED : January 21, 1997

INVENTOR(S) : Yau et al.

It is certified that error appears in the above-identified patent and that said Letters Patent is hereby corrected as shown below:

In column 4 at line 48 delete "he" and insert --be--

Signed and Sealed this

Twenty-ninth Day of April, 1997

*Attest:*

*Attesting Officer*

BRUCE LEHMAN

*Commissioner of Patents and Trademarks*